United States Patent [19]

Braun

[11] 4,366,989

[45] Jan. 4, 1983

[54] COAL PLANER CONTROL DEVICE

[75] Inventor: Gert Braun, Essen-Heisingen, Fed. Rep. of Germany

[73] Assignee: Halbach & Braun, Fed. Rep. of Germany

[21] Appl. No.: 195,298

[22] Filed: Oct. 8, 1980

[30] Foreign Application Priority Data

Oct. 18, 1979 [DE] Fed. Rep. of Germany ..... 2942089

[51] Int. Cl.[3] ..... E21C 27/32

[52] U.S. Cl. ..... 299/34; 299/43

[58] Field of Search ..... 299/43, 34

[56] References Cited

U.S. PATENT DOCUMENTS 3,779,604 12/1973 Heyer ..... 299/34

3,841,706 10/1974 Huttenbrauck ..... 299/34

FOREIGN PATENT DOCUMENTS 546713 3/1977 U.S.S.R. ..... 299/34

*Primary Examiner*—William F. Pate, III

*Attorney, Agent, or Firm*—McGlew and Tuttle

[57] ABSTRACT

A coal planer control device for a coal planer connected to a longwall conveyor having a waste side comprising, a bracket connected to the conveyor, a skid rest pivotally mounted to the bracket for pivotal movement against a mine floor to raise the bracket and tilt the coal planer at a selected angle to a longwall of a coal mine. A lifting mechanism is connected between the bracket and rest for pivotally moving the rest with respect to the bracket and a locking mechanism is connected between the bracket and rest for fixing the position to which the rest was moved by the lifting mechanism. The bracket and rest are pivotally connected to each other substantially along the entire length thereof and both extend substantially along the entire length of the longwall conveyor.

8 Claims, 7 Drawing Figures

COAL PLANER CONTROL DEVICE

FIELD AND BACKGROUND OF THE INVENTION

The present invention relates in general to coal mining devices and in particular to a new and useful planer control device intended for controlling the elevation of a coal planer or plow which is guided at a coal face on a longwall conveyor with the interposition of a planer guide. The device comprises a lifting mechanism mounted on the waste side of the conveyor with the interposition of a bracket. Coal planer controls serve the purpose of compensating for local irregularities of the footwall or floor, or for a deviation of the planer from the desired cutting horizon. To this end, the longwall conveyor is lifted or lowered by means of a lifting mechanism provided at the waste side. In the lowered position, the planer is brought to climbing, in the lifted position to dipping. With the coal planer adjusted to the desired cutting horizon, the lifting mechanism is in its neutral position.

In prior art planer control devices, rocker-type and jib-type controls are primarily used. Both these controls have the disadvantage that, at least with the conveyor in a dipping position, the conveyor trough is lifted from the floor and fine coal from the coal face can migrate to the waste side. This creates fire hazards at the waste side. In addition, with thin seams and high rates of advance, considerable amounts of coal are lost. Further, the lifting mechanism which, in both instances, are hyrdaulically operated cylinders, are continuously under working load. The result is not only increased stresses and shortened life but also drops in the working load, at least partly. In consequence, the conveyor may subside from its adjusted control position spontaneously. This entails an insufficient control of the planer, even in instances where the conveyor is in its normal or climbing position, since in this case again, the control cylinder is usually under working load.

The purpose of the invention is to eliminate these drawbacks.

SUMMARY OF THE INVENTION

The present invention is directed to a device for controlling the position, in elevation, of a coal planer while preventing the fine coal from migrating to the waste side of a coal conveyor and ensuring that after setting the planer to the desired cutting horizon, the lifting mechanism is relieved of load and the adjusted control position of the conveyor remains unchanged.

An object of the present invention is to provide a coal planer control device of a coal planer connected to a longwall conveyor having a waste side comprising, a bracket connected to the conveyor, a skid rest pivotally mounted to the bracket and adapted to be pivotally moved against a mine floor to raise the bracket, lifting means connected between the bracket and skid rest for pivotally moving the skid rest into a selected position to tilt the planer into a selected position, and locker means connected to the bracket and engaged with the skid rest to hold the skid rest and planer in the selected position.

Due to the inventive structure, fine coal is securely prevented from passing to the waste side of the conveyor. Instead, the fine coal accumulating below the conveyor trough is pushed toward the face during the shifting motions of the conveyor. This eliminates fire hazards, and considerably reduces losses of fine coal, especially in thin seams and with high rates of advance of the plane. In addition, the locking mechanism makes sure that the conveyor is fixed in its position which is adjusted by the lifting mechanism, irrespective of whether this position is normal, or for climbing or dipping. The lifting mechanism can then always be relieved of load. A spontaneous change of the angle of inclination of the conveyor, and thus of the adjusted cutting horizon of the planer, is prevented. This is particularly important if the conveyor is in its normal or dipping position in which the waste side of the trough is not in contact with the floor. Even in the climbing position, however, there is no need for having the conveyor trough resting against the floor at the waste side. The inventive planer control device thus enhances fire protection, reduces coal losses, and ensures that the once adjusted controlled position of the conveyor at the planer is exactly maintained. These are the substantial advantages of the invention.

Additional important features of the invention are as follows: The skid rest is hinged to the lower edge of the bracket, the entire length, thereof, by means of a hinge joint whose pin has the same length. In this way, a satisfactorily stable and yet articulate connection is obtained between the rest and the bracket, making it possible to lift the conveyor by correspondingly varying the angle of the adjustment between the rest and the bracket.

Advantageously, the rest is designed as an angle section which is closed toward the floor with one leg of the section being used for forming the hinge with the bracket and the other leg serving as a support for the locking mechanism. The lifting mechanism is designed, in a manner known per se, as a pneumatically or hydraulically operated control cylinder, preferably suspended from the bracket by its one end and attached to the rest by its other end and is mounted between two bearing cheeks by means of hinge bolts. The cylinder is provided in the central zone of the bracket and rest extension, so that a single cylinder for each conveyor trough section, and thus bracket or rest section having the same length, is sufficient to achieve the desired control. The invention further teaches that the cheeks have extensions on their waste side in which obliquely extending guide slots are provided. The upper end of the slot is located at the level of the trough bottom of the conveyor. Oblique guide slots are known in cutter assemblies, however, they have not been applied to planer controls as of yet. Due to the oblique guide slots extending between the trough bottom level and the floor zone, strain of the conveyor trough under the action of the shifter cylinders can be reduced. That is, during the pushing operation, the hinge joint of the shifter cylinder, and thus the point of application of the force, is displaced to the level of the trough bottom, while during the operation of pulling the supports, the hinge point of the shifter cylinder, and thus the point of application of the force, is re-located substantially to the floor level. In both instances, the lengths of the effort arms or the moments are considerably reduced.

Another object of the present invention is to provide a coal planer control device wherein the locking means comprises a U-shaped section which is guided for adjustment in height in a guide cheek or plate of the bracket. The legs of the U-shaped section straddle the guide cheek and are provided with a plurality of thru holes which are arranged in rows, one atop the other, and aligned with each other to receive a locking bolt. End faces of the legs have arcuate recesses forming an articular seat for associated leg edges of the skid rest. The guide cheek is provided with at least one lock hole located in alignment with the row of thru holes for receiving the locking bolt and with a vertical guide slot extending parallel to the row of thruholes for receiving a guide bolt connected to the legs.

The angular position of the skid rest relative to the floor can thus be adjusted by means of the lifting mechanism while at the same time elevating or lowering the conveyor, to bring two of the thru holes in the U-section in alignment with the lock hole in the guide cheek, so that the locking bolt may be inserted to mechanically fix the conveyor in its control position. It is possible to provide, in the guide cheek, a plurality of lock holes arranged one above the other but with a spacing different from that of the thru holes, to obtain as differentiated a vertical adjustment as possible. In the area of the arcuate recess, the U-section locked to the guide cheek of the bracket bears against the corresponding leg edge of the rest which slides in the recess during the operation of height adjustment. Screw bolts are preferably used as the guide and locking bolts.

The web of the U-section may in addition be designed as an abutment strip for the roof supports moving up. This strip brings the pulled support automatically in alignment and prevents a casual penetration, for example, of the floor sills of shield supports, beneath the conveyor. Further, one locking mechanism is provided symmetrically at either side of the lifting mechanism, so as to ensure a uniform loading of the rest, the bracket, and of the conveyor which is thereby protected from distortion.

A still further object of the invention is to provide a coal planer control device for a coal planer which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the following, one embodiment of the invention is explained in more detail with reference to the accompanying drawings in which.

DESCRIPTION OF THE PREFERRED EMBODIMENT

Figure 1:
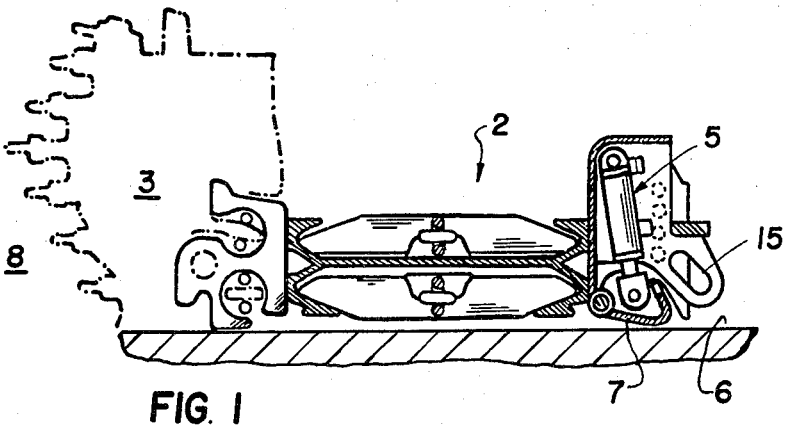
FIG. 1 is a diagrammatical sectional illustration of an inventive coal planer control assembly comprising a longwall conveyor, a planer guide, and a planer, in normal position.
Figure 2:
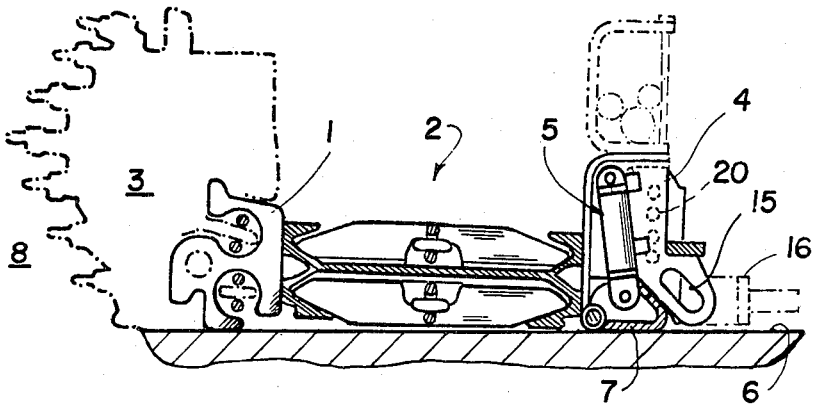
FIG. 2 is a view similar to FIG. 1 showing the climbing position.
Figure 3:
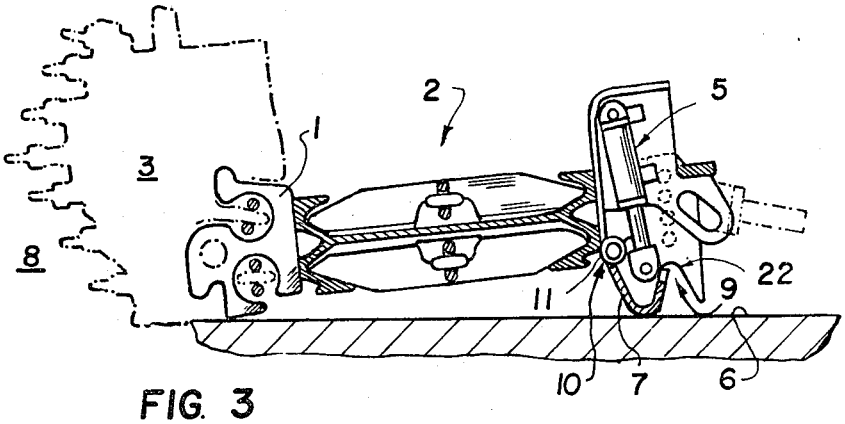
FIG. 3 is a view similar to FIG. 1 showing the dipping position.
Figure 4:
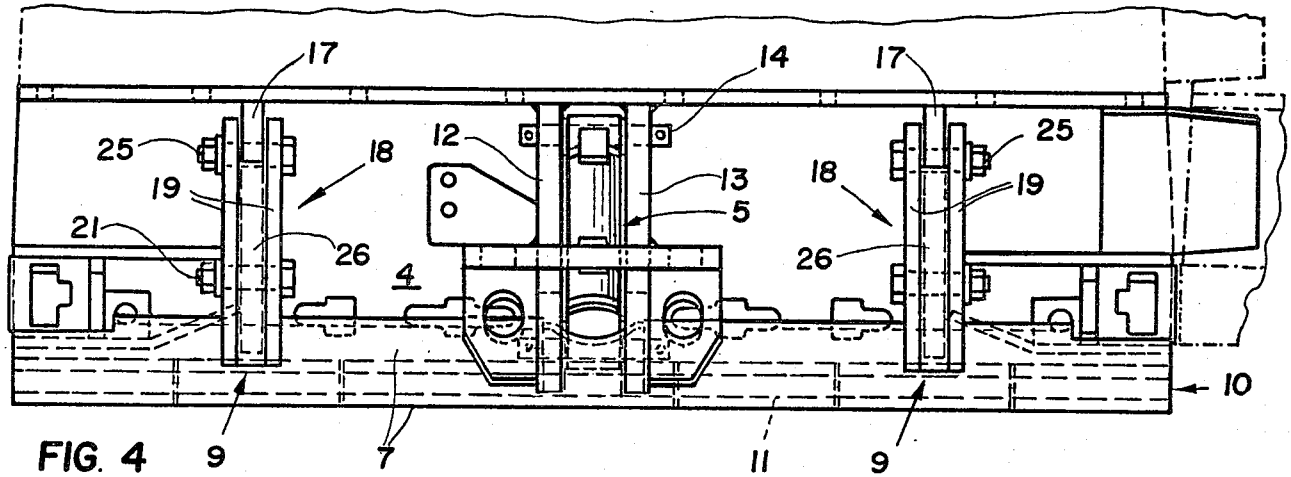
FIG. 4 is a frontal elevational view of the inventive planer control device.
Figure 5:
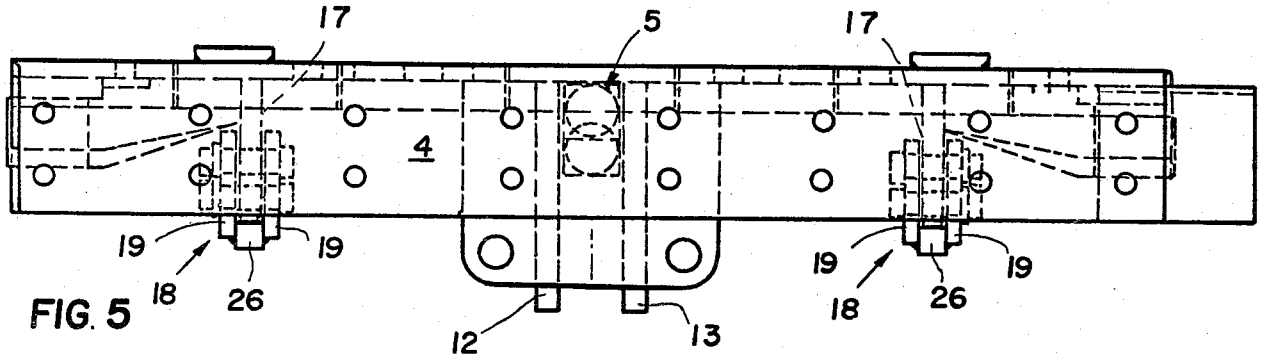
FIG. 5 is a top plan view of the device of FIG. 4.
Figure 7:
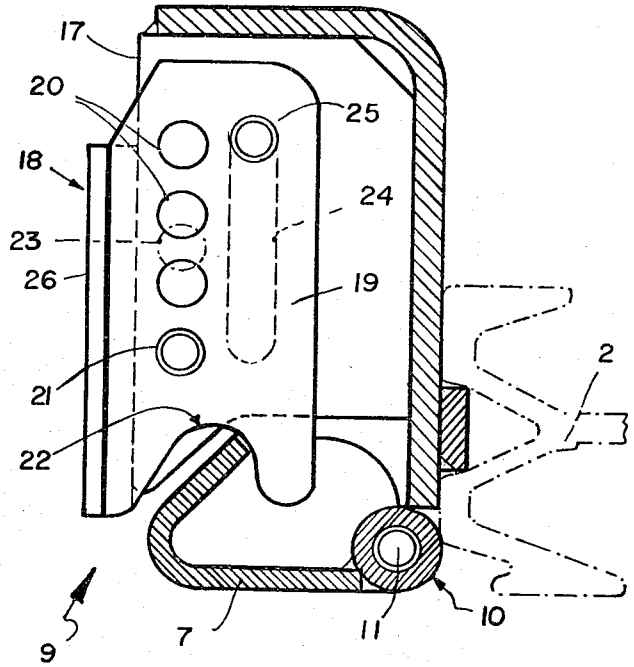
FIG. 7 is an opposite side elevational view similar to FIG. 6 and taken in the zone of one of the locking mechanism.
Figure 6:
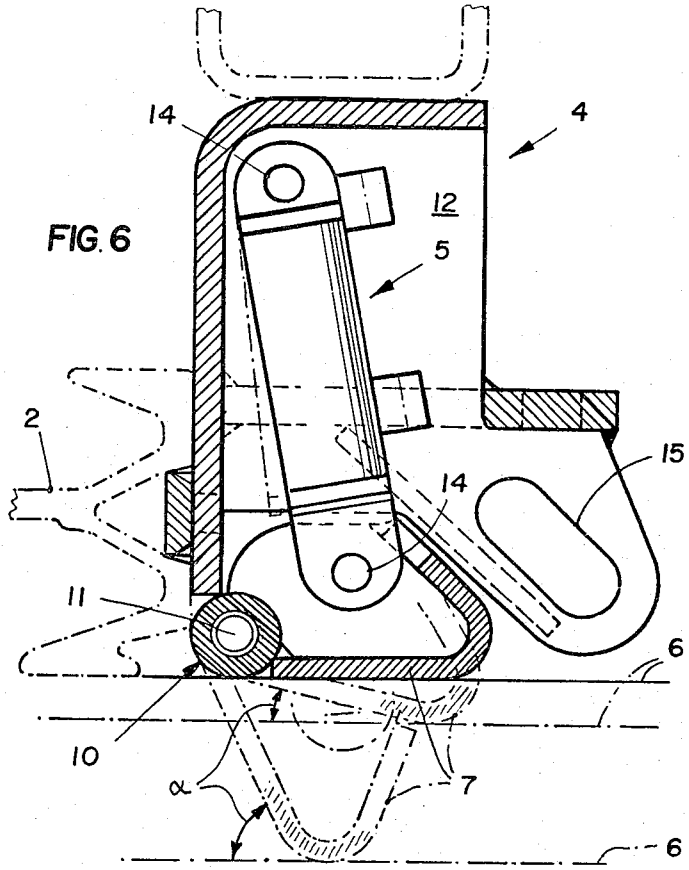
FIG. 6 is a side elevational and enlarged detail of the device of FIG. 4 taken in the zone of the lifting mechanism.

Referring to the drawings in particular the figures show a planer control assembly for controlling the elevation of a coal planer 3 which is guided on a longwall conveyor 2 with the interposition of a planer guide 1, comprising a lifting mechanism 5 which is connected to conveyor 2 through a control bracket 4. A skid rest 7 is connected to bracket 2 which extends in the longitudinal direction of the bracket and thus parallel to conveyor 2 and can be pivoted toward the floor 6. Lifting mechanism 5 is hinged by one end to bracket 4 and by its other end to rest 7. To lock rest 7 in position at a definite angle alpha (FIG. 6) relative to the floor 6, which angle can be adjusted by means of lifting mechanism 5 and determines the angle of inclination of conveyor 2 relative to the floor and the angle of attack of planer 3 at the coal face 8, at least one locking mechanism 9 which is adjustable in height is connected to bracket 4 and supported on rest 7. Bracket 4 and rest 7 are of equal length and rest 7 is hinged to the lower edge of bracket 4 by means of a hinge joint 10 whose hinge pin 11 extends the entire length of bracket 4. Rest 7 is designed as an angle section which is closed toward the floor, with one leg of the section being used for forming the hinge joint 10 with bracket 4, and the other leg serving as support for locking mechanism 9. Lifting mechanism 5 is designed as a pneumatically or hydraulically operated control cylinder which is mounted by means of joint bolts 14 between two bearing cheeks 12, 13 provided in the central zone of extension of bracket 4 and rest 7, and thus suspended by one end from bracket 4 and attached by its other end to rest 7. On their waste side (away from face 8) bearing cheeks 12, 13 of bracket 4 are formed with extensions which are provided with inclined guide slots 15 for connecting a shifter cylinder 16 which is indicated in FIG. 2 in its position during the pulling operation, and in FIG. 3 in its position during the pushing operation. The extension of guide slots 15 is such that their upper ends are at the level of the trough bottom of conveyor 2 while their lower ends come to lie closer to floor 6. Locking mechanism 9 comprises a U-section 18 which is guided for adjustment in height on a guide cheek 17 of bracket 4 and whose U-legs 19 straddling guide cheek 17 are provided with a plurality of thru holes 20 aligned in a row one above the other for receiving a locking bolt 21. The legs 19 of section 18 are further provided with an arcuate recess 22 on their ends facing rest 7, which is intended as an articular or slide seat for the associated leg of rest 7. Guide cheek 17 is provided with at least one lock hole 23 aligned with the row of thru holes 20 for locking bolt 21, and with a vertical guide slot 24 which extends parallel to the row of thru holes 20 and is intended to receive a guide bolt 25 connecting U-legs 19. The web of U-section 18 is formed as an abutment strip 26 for the shifted roof supports and extends to the proximity of floor 6. Advantageously, one locking mechanism 9 is provided symmetrically at either side of lifting mechanism 5. Locking mechanism 9 serve the purpose of mechanically fixing conveyor 2 and thus planer 3 in the control position adjusted by lifting mechanism 5, namely the normal, climbing, or dipping position, in order both to relieve the lifting mechanism 5 of load and to prevent a spontaneous misadjustment of the once set control position.

While a specific embodiment of the invention has been shown and described in detail to illustrate the application of the principles of the invention, it will be understood that the invention may be embodied otherwise without departing from such principles.

What is claimed is:

1. A coal planer control device for a coal planer connected to a longwall conveyor having a waste side comprising, a bracket connected to the conveyor, a skid rest pivotally connected to the bracket and adapted to be pivotally moved against a mine floor to raise the bracket and tilt the coal planer, lifting means connected between the bracket and the skid rest for pivotally moving the skid rest into a selected position to tilt the planer into a selected position, locking means connected to the bracket and engaged with the skid rest to hold the skid rest and planer in the selected position, and the bracket and skid rest extending the entire length of the longwall conveyor, the skid rest being hinged to the bracket, at a lower edge of the bracket along the entire length of the bracket and skid rest.

2. A coal planer control device for a coal planer connected to a longwall conveyor having a waste side comprising, a bracket connected to the conveyor, a skid rest pivotally connected to the bracket and adapted to be pivotally moved against a mine floor to raise the bracket and tilt the coal planer, lifting means connected between the bracket and the skid rest for pivotally moving the skid rest into a selected position to tilt the planer into position, locking means connected to the bracket and engaged with the skid rest to hold the skid rest and planer in the selected position, and the skid rest having an angle cross-sectional shape which is closed in a direction facing a mine floor, one leg of the skid rest connected to a lower edge of the bracket and another leg of the skid rest engaging the locking means.

3. A coal planer control device for a coal planer connected to a longwall conveyor having a waste side comprising, a bracket connected to the conveyor, a skid rest pivotally connected to the bracket and adapted to be pivotally moved against a mine floor to raise the bracket and tilt the coal planer, lifting means connected between the bracket and the skid rest for pivotally moving the skid rest into a selected position to tilt the planer into a selected position, locking means connected to the bracket and engaged with the skid rest to hold the skid rest and planer in the selected position, said lifting means comprising a control cylinder which is pivotally mounted to the bracket and the skid rest, and a pair of cheek plates connected to the bracket, the control cylinder pivotally connected between the pair of cheek plates, the cheek plates being positioned at a central location on the bracket and skid rest.

4. A coal planer control device for a coal planer connected to a longwall conveyor having a waste side comprising, a bracket connected to the conveyor, a skid rest pivotally connected to the bracket and adapted to be pivotally moved against a mine floor to raise the bracket and tilt the coal planer, lifting means connected between the bracket and the skid rest for pivotally moving the skid rest into a selected position to tilt the planer into a selected position, locking means connected to the bracket and engaged with the skid rest to hold the skid rest and planer in the selected position, said lifting means comprising a control cylinder which is pivotally mounted to the bracket and the skid rest, and extensions extending from the cheek plates on the waste side of the longwall conveyor, an oblique guide slot in each of the extensions adapted to be connected to a shifting cylinder, an upper end of the slot being at a level of a trough bottom of the conveyor and a lower end of the slot being in the vicinity of the mine floor.

5. A coal planer control device for a coal planer connected to a longwall conveyor having a waste side comprising, a bracket connected to the conveyor, a skid rest pivotally connected to the bracket and adapted to be pivotally moved against a mine floor to raise the bracket and tilt the coal planer, lifting means connected between the bracket and the skid rest for pivotally moving the skid rest into a selected position to tilt the planer into a selected position, locking means connected to the bracket and engaged with the skid rest to hold the skid rest and planer in the selected position, and said locking means comprising a U-shaped section, a guide plate connected to the bracket for guiding the U-shaped section, legs of the U-shaped section saddling the guide cheek plate and being provided with a plurality of thru holes which are aligned in rows one above the other, the guide cheek plate including at least one lock hole located in alignment with the row of thru holes on the legs, a locking bolt engageable through the at least one lock hole and at least one of the thru holes for locking the U-shaped section at a selected location, the legs each including an arcuate recess engaged with the skid rest for maintaining the skid rest in its selected position.

6. A coal planer control device according to claim 5, wherein the guide cheek plate includes a vertically extending guide slot extending substantially parallel to the row of thru holes through the legs, a guide bolt connected to the legs and extending through the guide slot.

7. A coal planer control device according to claim 5, including an abutment strip forming a portion of the U-shaped section adapted to extend about from the mine floor upwardly.

8. A coal planer control device for a coal planer connected to a longwall conveyor having a waste skid comprising, a bracket connected to the conveyor, a skid rest pivotally connected to the bracket and adapted to be pivotally moved against a mine floor to raise the bracket and tilt the coal planer, lifting means connected between the bracket and the skid rest for pivotally moving the skid rest into a selected position to tilt the planer into a selected position, locking means connected to the bracket and engaged with the skid rest to hold the skid rest and planer in the selected position, and a pair of locking means positioned symmetrically on either side of the lifting means.

* * * * *